US005578801A

United States Patent [19]

Hofmann

[11] Patent Number: 5,578,801

[45] Date of Patent: Nov. 26, 1996

[54] APPARATUS AND METHOD FOR SENSING SLIPPAGE OF ELEVATOR DRIVE CABLE OVER A TRACTION SHEAVE

[75] Inventor: Hanspeter Hofmann, Neukeferloh, Germany

[73] Assignee: Technischer Uberwachungs-Verein Bayern e.V., Munich, Germany

[21] Appl. No.: 688,487

[22] PCT Filed: Mar. 23, 1990

[86] PCT No.: PCT/EP90/00477

§ 371 Date: Aug. 1, 1991

§ 102(e) Date: Aug. 1, 1991

[87] PCT Pub. No.: WO90/11958

PCT Pub. Date: Oct. 18, 1990

[30] Foreign Application Priority Data

Apr. 7, 1989 [DE] Germany ..... 8904375 U

[51] Int. Cl.[6] ..... B66B 5/02

[52] U.S. Cl. ..... 187/393; 187/391; 187/287; 187/390

[58] Field of Search ..... 187/134, 133, 187/130, 131, 112, 136, 135, 116, 118, 140, 106, 393, 394, 391, 390, 279, 287, 288

[56] References Cited

U.S. PATENT DOCUMENTS

| | | | |
|---|---|---|---|
| 3,773,146 | 11/1973 | Dixon et al. | 187/29 |
| 3,781,901 | 12/1973 | Morrison | 346/1 |
| 4,085,823 | 4/1978 | Capoto et al. | 187/116 |
| 4,698,780 | 10/1987 | Mandel et al. | 364/550 |
| 4,704,597 | 11/1987 | Sasao | 187/134 |
| 4,771,865 | 9/1988 | Hinderling | 187/130 |
| 4,833,380 | 5/1989 | Magee | 318/484 |
| 4,864,208 | 9/1989 | Schroder | 318/603 |
| 4,936,136 | 6/1990 | Vanhala | 73/9 |
| 4,936,419 | 6/1990 | Stadler et al. | 187/133 |
| 4,959,808 | 9/1990 | Neuffer et al. | 364/566 |
| 5,042,621 | 8/1991 | Ovaska et al. | 187/133 |
| 5,070,967 | 12/1991 | Katzy et al. | 187/116 |
| 5,233,139 | 8/1993 | Hofmann | 187/133 |

FOREIGN PATENT DOCUMENTS

| | | | |
|---|---|---|---|
| 0192513 | 1/1986 | European Pat. Off. . | |
| 0252266 | 5/1987 | European Pat. Off. . | |
| 3822466A1 | 2/1989 | Germany . | |
| 1253-928-a | 2/1986 | U.S.S.R. | 187/130 |
| 2136158 | 9/1984 | United Kingdom . | |

*Primary Examiner*—Robert Nappi

*Attorney, Agent, or Firm*—Finnegan, Henderson, Farabow, Garrett and Dunner, L.L.P.

[57] ABSTRACT

An elevator includes an evaluation unit. A pair of position pick-ups are connected to the cable assembly and/or driving pulley of the elevator and coupled to the input of the evaluation unit. The elevator is accelerated or decelerated for checking adhesion of the cable onto the driving pulley (traction sheave). The motion parameters of the cable assembly and the driving pulley are sensed separately, and the drive capability can be determined therefrom.

25 Claims, 9 Drawing Sheets

APPARATUS AND METHOD FOR SENSING SLIPPAGE OF ELEVATOR DRIVE CABLE OVER A TRACTION SHEAVE

This invention relates to an apparatus for sensing physical characteristics, in particular motion parameters, of a freight and/or load elevator, with the elevator comprising at least one cable assembly which is guided over a driving pulley and whose one end has suspended therefrom the elevator car and whose other end a counterweight, and said elevator being driven by a drive motor which is controlled by an electric control circuit and acts on the driving pulley, and including a braking device which is connected to the driving pulley and controlled by the control circuit.

Safety tests which are performed with freight and passenger elevators form the background of the present invention. Elevators of this type must be controlled at regular intervals, and characteristics such as paths of travel, braking paths, catch paths and non-slippage (drive capability) of the cable assembly, which is driven by the driving pulley, have to be determined.

The checking of elevators has so far involved a lot of work because the testing of the function of the brake and the catch device required the loading of the elevator with the admissible useful load or even with 1.5 times the useful load when the non-slippage property was checked. The loading and unloading operations in connection with the necessary weights are not only time-consuming, but also call for great physical efforts. Moreover, the weight test for the elevator system greatly stresses the loaded components.

U.S. Pat. No. 3,781,901 discloses an apparatus for displaying and storing an elevator movement. The rotation of the driving pulley of the elevator is sensed by a sensor and plotted on a time-path diagram for observing the elevator movement. The elevator movement is thereby to be optimized if necessary. DE-A-3822488 discloses a method for controlling position and movement of a cable-moved transportation means so as to determine cable slippage and stretching properties of the carrying cables during operation. The signals that are evaluated for determining the position are directly obtained in an optoelectronic way from the existing form of the cabled elements moving the transportation means.

In the two above-mentioned documents the checking of elevators is not at all possible or can only be carried out under great efforts.

It is the object of the present invention to provide means which are used for checking freight/and or passenger elevators and with the aid of which the amount of work spent on the test method is considerably reduced while the test quality is increased at the same time.

In accordance with the invention, this object is attained in that there is provided an evaluation unit with a timer, as well as a position pick-up which communicates with the cable assembly and/or the driving pulley and is connected to an input of the evaluation unit, and in that the evaluation unit comprises other inputs which are connectable to switching points of the control unit at which signals are present for controlling the sequence of motions of the elevator.

Kinematic elevator data, i.e. travel path values and the associated time measurement values, can be determined with such an apparatus in response to the signals that control the sequence of motions of the elevator, and the necessary test characteristics can be found on the basis of the kinematic data. As far as safety aspects are concerned, the test method of the invention is a considerably improvement as there are no heavy loads acting on the elevator during testing.

In particular, the evaluation unit advantaeously includes a means for determining and recording distance, speed and acceleration values as a function of time and path. The recorded braking and catch curves are displayed on a screen or printed out by a printer and superimposed with calculated envelopes (which set admissible upper and lower limits). The effectiveness of the brake and the catch device can thus be determined in an easy way. The determined curves may be stored on a data carrier. The evaluation means expediently comprises a computer, preferably a personal computer.

In another expedient embodiment the apparatus of the invention comprises a force sensing element which is connected to the cable assembly and with the aid of which the forces that are transmitted by the cable assembly and determine the sequence of motions of the elevator car can be determined. Especially the non-slippage property of the cable assembly, which is driven by the driving pulley, can advantageously be checked by means of such a force measurement.

An advantageous development of the invention consists in a method for sensing physical characteristics. The cable, the elevator car and the counterweight are specifically accelerated or decelerated during normal travel operation for checking the adhesion of the cable to the driving pulley. The motion parameters of the cable and the driving pulley are here sensed separately in dependence upon time.

It is of advantage when the motion parameters of cable and driving pulley are additionally compared with a given motional limit parameter (e.g. a limit curve). When the limit value is exceeded, the drive capability of the driving pulley is ensured at any rate.

An advantageous development also exists when, in the case of different motion parameters of cable and driving pulley, the drive capability of the driving pulley is determined on the basis of the difference measured.

Other expedient embodiments of the invention will become apparent from the subclaims.

The invention shall now be explained and described in more detail with reference to the embodiments and the attached drawings, in which:

FIG. 10 shows another embodiment of a force sensor with dial gauge for use in an apparatus of the invention;

An elevator system which is to be checked by the apparatus of the invention shall first of all be described so that it will be more easy to explain the function of the inventive apparatus further down in the text.

Figure 1:
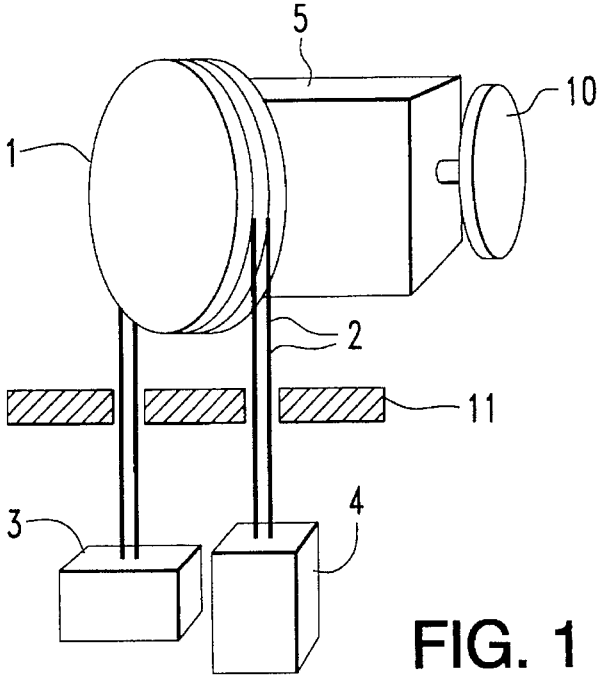
FIG. 1 (schematically) shows an elevator system wherein the apparatus of the invention is used for checking purposes.

In FIG. 1 reference numeral 1 designates a driving pulley which comprises two guide grooves for a cable assembly 2, which is formed by two cables in the present case. An elevator car 3 is secured to one end of cable assembly 2. A counterweight 4 is suspended at the other end of cable assembly 2. The mass of counterweight 4 generally corresponds to the mass of elevator car 3 plus half the admissible car load. 5 designates a motor-gearing-brake unit for the drive of driving pulley 1. This unit includes a hand wheel 10 for rotating driving pulley 1. Unit 5 includes a brake for driving pulley 1. Unit 5, including driving pulley 1, is located above a ceiling 11 closing the elevator shaft upwards.

During travel elevator car 3 is moved via cable assembly 2, which is driven by the motor-gearing-brake unit via driving pulley 1. It is necessary for a perfect operation of the elevator system that the cable assembly be placed relative to the driving pulley in a sufficiently non-slipping way. The elevator car can also be moved by hand wheel 10 in case of need, or during repair or checking operations.

Figure 2:
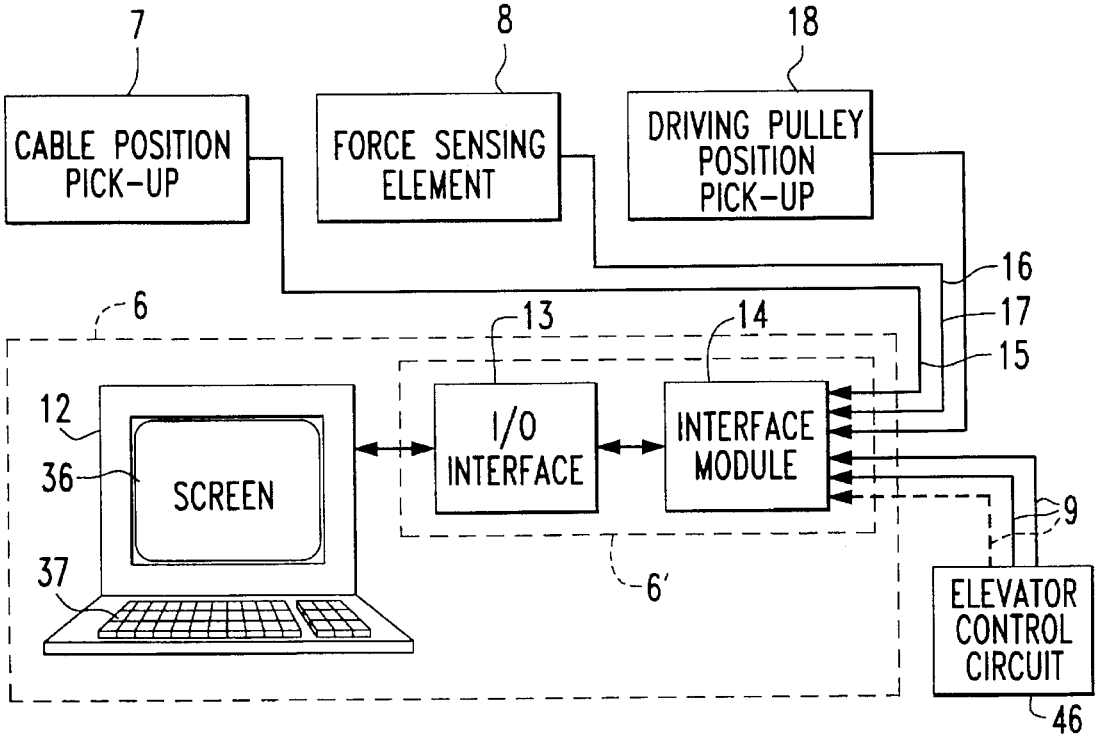
FIG. 2 is a schematic representation of an embodiment of an apparatus of the invention.

In FIG. 2 reference numeral 8 designates an evaluation unit which includes a personal computer 12, an input/output interface 13 and an interface module 14 in the present embodiment. The broken border line 6' is to indicate that the input/output interface 13 and the interface module 14 form a functional unit. As a rule, the personal computer includes a screen 38 as a display device as well as an entry keyboard 37. Data is exchanged in both directions between the individual modules of the evaluation unit in accordance with the plotted arrows connecting the modules. In the present embodiment evaluation unit 8 is respectively connected via one of lines 15–17 to a first position pick-up 7 which may be in motional communication with a cable of cable assembly 2, to a second position pick-up 18 which may be in motional communication with driving pulley 1, e.g. through contact, and to a force sensing element 8, with the lines being connected to the evaluation unit via inputs provided on the interface module. Reference numeral 9 designates lines through which the evaluation unit is connected to control circuit 48 of the elevator system. Like lines 15–17, lines 9 are connected to inputs provided on interface module 14.

In the present embodiment lines 9 are combined to form a twelve-core shielded cable. A test plug which is connectable to control circuit 48 of the elevator system is provided at one end of the shielded cable and a circuit board connector with a voltage protection wiring at its other end.

Interface module 14 comprises four subassemblies. A partial control interface is provided for electrical signals that are transmitted by control circuit 48 via lines 9 to the evaluation unit. At each input this partial interface includes an optocoupler for electrically isolating the evaluation unit from the control circuit, an operational amplifier which is used for amplifying signals and provided with a capacitive feedback and is to be operated with one operating voltage only, as well as a Schmitt trigger. A partial sensor interface of a substantially symmetrical structure is provided for sensing and preprocessing signals of the position pick-ups and the force sensing element. As a third subassembly, the interface module 14 comprises a divider module for dividing the system clock of personal computer 12. Finally, the interface module includes an acoustic transducer which comprises a monoflop having a pulse width of about 500 ms and a piezoelectric bleeper arranged downstream thereof.

The input/output interface includes decoder, input/output and timer modules. The timer module includes a universally programmable counter whose clock input is connected to the system clock of the personal computer via the divider module of the interface module.

Figure 3:
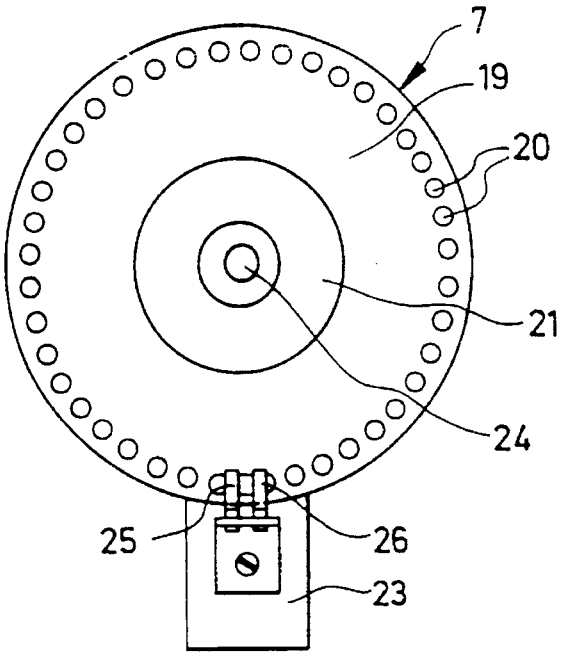
FIG. 3 is a front view of an embodiment regarding a position pick-up usable in an apparatus of the invention.
Figure 4:
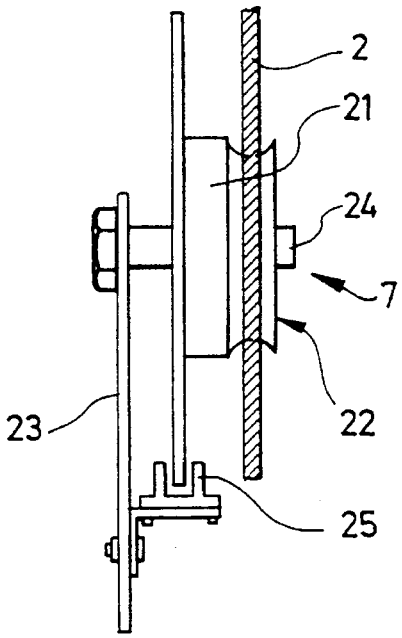
FIG. 4 is a side view of the position pick-up according to FIG. 3.
Figure 5:
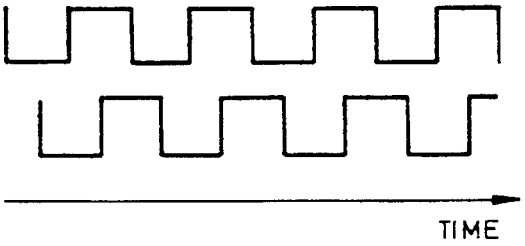
FIG. 5 shows time diagrams of the measuring signals that are output by the position pick-up according to FIGS. 3 and 4.
Figure 6:
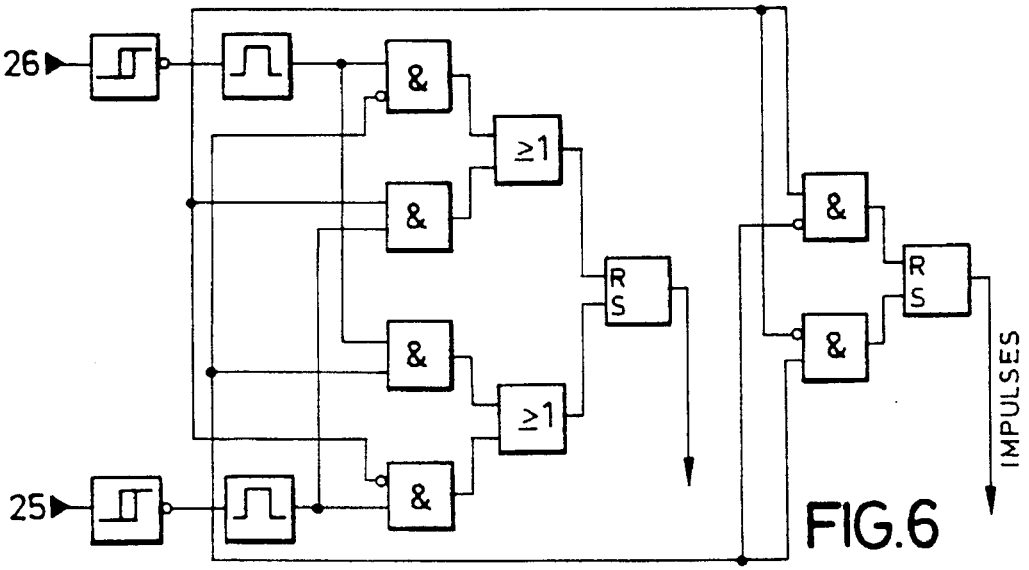
FIG. 6 shows an evaluation circuit for evaluating the measuring signals output by the position pick-up according to FIGS. 3 and 4, 7, 8, 9 and 11, respectively.

FIGS. 3 and 4 are a front view and side view, respectively, of an embodiment regarding a position pick-up as may be used in an apparatus according to FIG. 2. The position pick-up comprises a perforated disk 19 with light passage holes 20 arranged concentrically at equal distances around the center of rotation of the perforated disk. The perforated disk is concentrically connected to a driving disk 21 provided with a guide slot for a driving cable of the cable assembly. The perforated disk 19 together with driving disk 21 includes a rotary axle 24 which is rotatably supported in a holding device 23. Reference numeral 25 designates a first light-barrier measuring device and reference numeral 26 a second light-barrier measuring device whose light rays can exit through or can be interrupted by the perforated disk. The distance between the two light barriers and the distance between the light passage holes on the perforated disk are so chosen that when the perforated disk is rotated in one direction, the pulse diagrams shown in FIG. 5 are obtained with time-staggered pulses for the signals of the two light barrier means. The direction of rotation can be determined by evaluating the measuring signals output by the two light barriers. A corresponding evaluation circuit is shown in FIG. 6. Apart from position pulses whose number is characteristic of the path of travel of the elevator car, the circuit also supplies a signal indicative of the motional direction of the elevator car.

Figure 12:
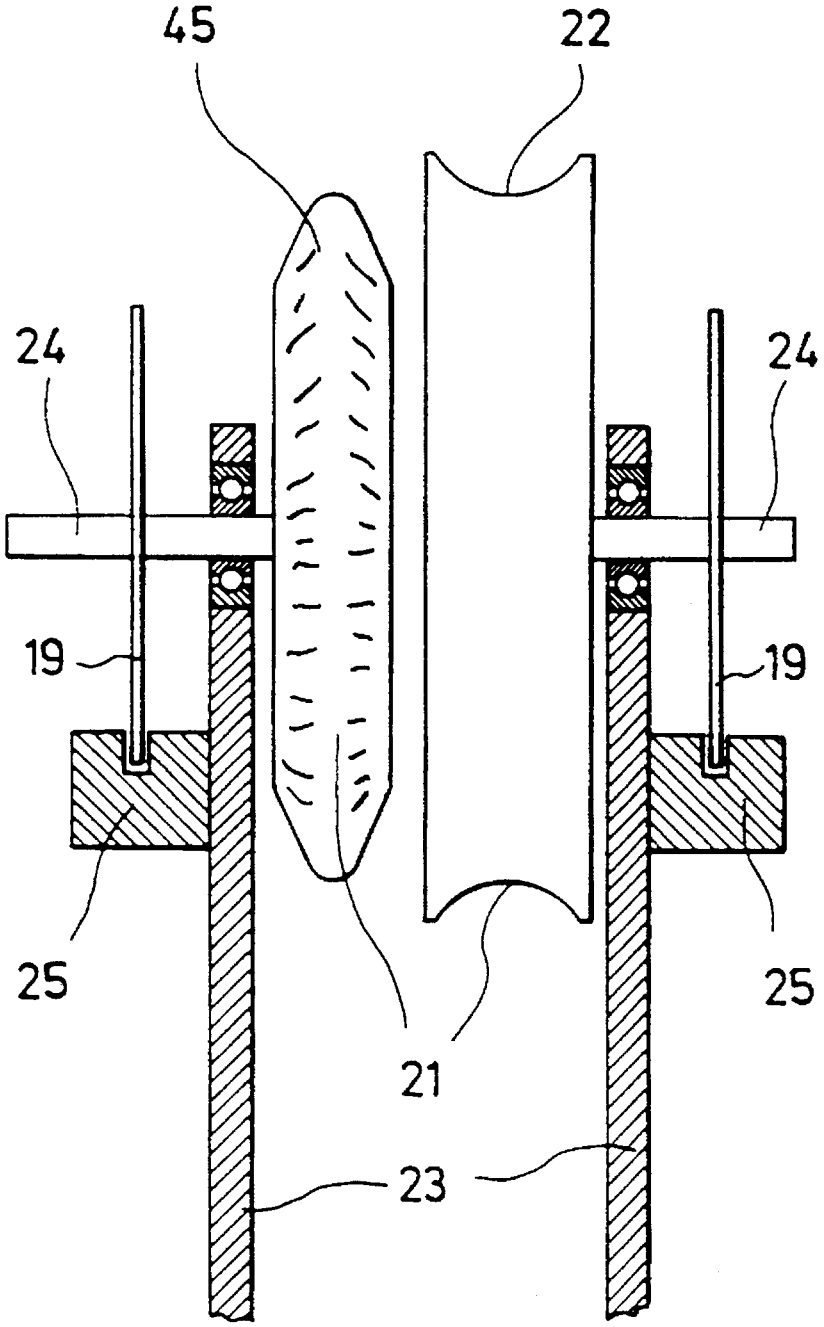
FIG. 12 shows an embodiment of a position pick-up used in an apparatus of the invention in the form of a double-type pick-up.

FIG. 12 shows an embodiment of a double-type position pick-up which combines the two pick-ups 7 and 18 in one unit. The two position pick-ups are displaceably supported relative to each other and can thus be pressed with the running surface 45 against the driving pulley and with the running groove 22' against a carrying cable. The operation of the individual pick-ups corresponds to that of the pick-up shown in FIGS. 3 and 4.

Figures 7, 8:
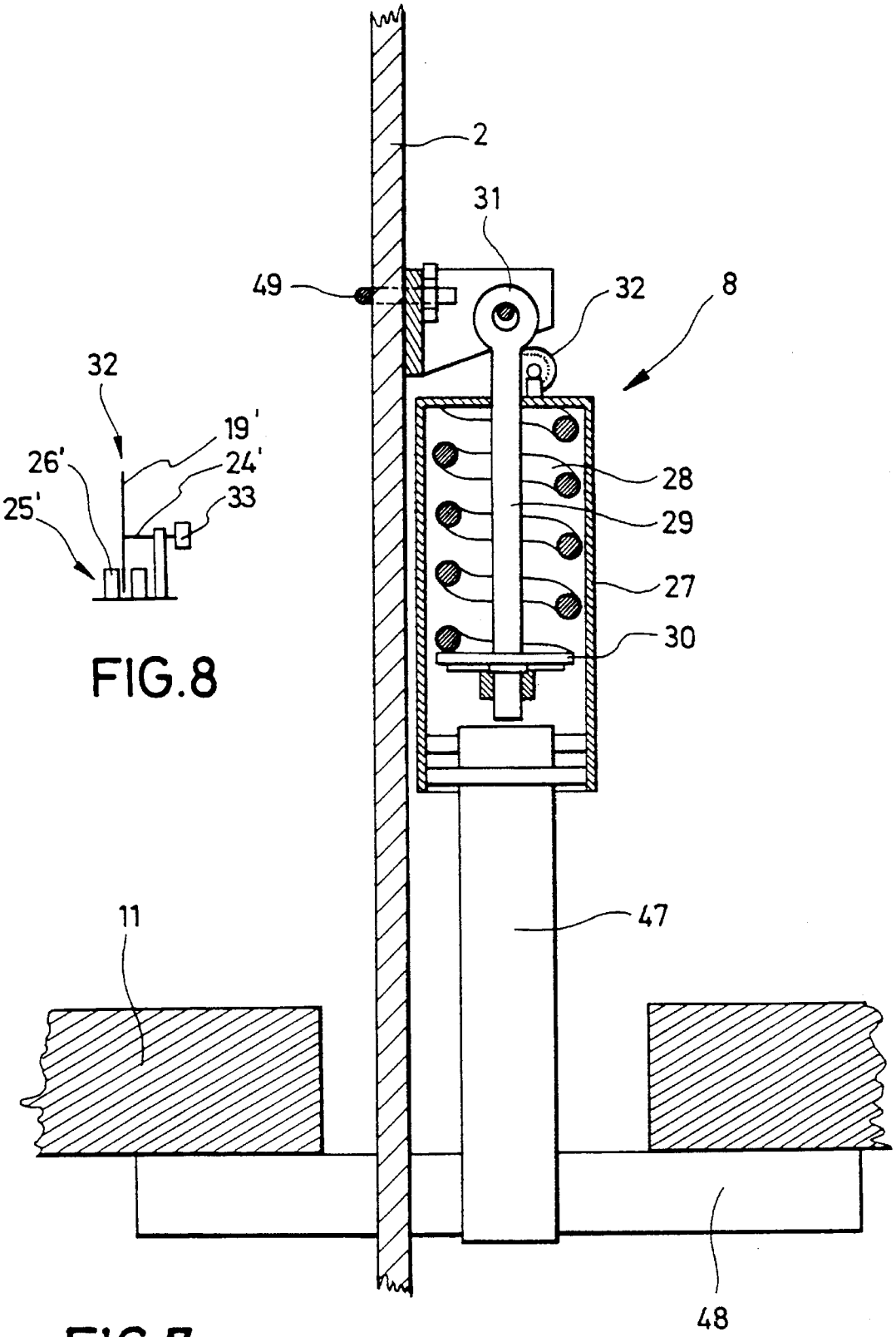
FIG. 7 shows an embodiment of a force sensing element usable in an apparatus of the invention.
FIG. 8 shows a position pick-up used in the force sensing element of FIG. 7 as a transducer.

FIG. 7 illustrates an embodiment of a force sensing element 8, which can be used in the apparatus. The force sensing element comprises a helical compression spring 28 which is guided in a guide sleeve 27 and can be compressed by a pull rod 29 which at one end comprises a disk 30, against which spring 28 comes to rest, and an eye 31 at the other end. Reference numeral 32 designates a position pick-up by which a displacement of pull rod 29 relative to guide sleeve 27 can be sensed and a measuring signal for the force acting on the pull rod can thus be supplied. The position pick-up 32 is separately shown in FIG. 8. Like the position pick-up illustrated in FIGS. 3 and 4, it includes a perforated disk 19' and two light-barrier measuring means 25' and 26'. Perforated disk 19' is connected via a rotary axle 24' to a driving wheel 33 which comes to rest on pull rod 29 and is driven by said pull rod.

Figure 9:
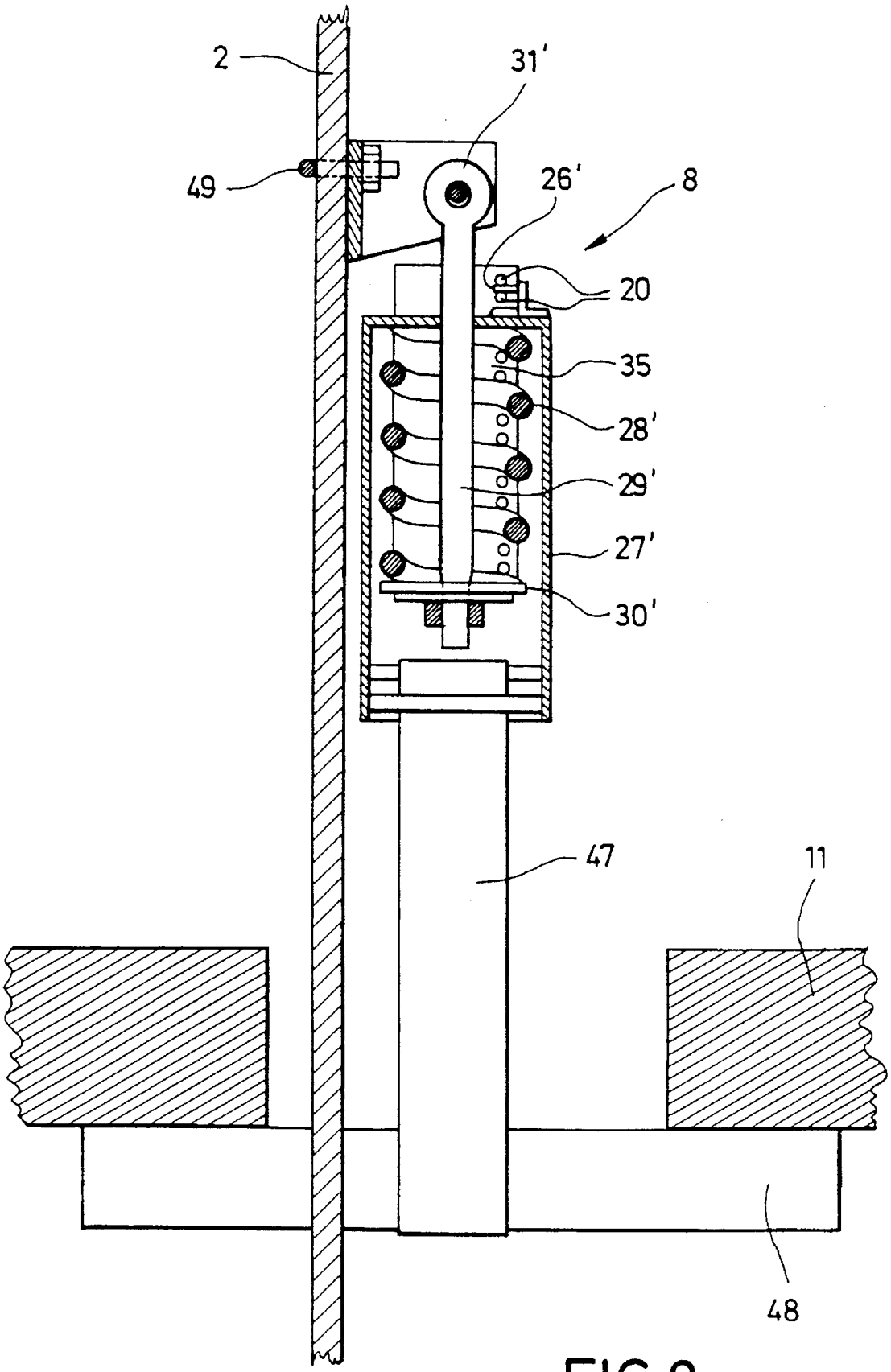
FIG. 9 shows another embodiment of a force sensing element usable in an apparatus of the invention.
Figure 1O:
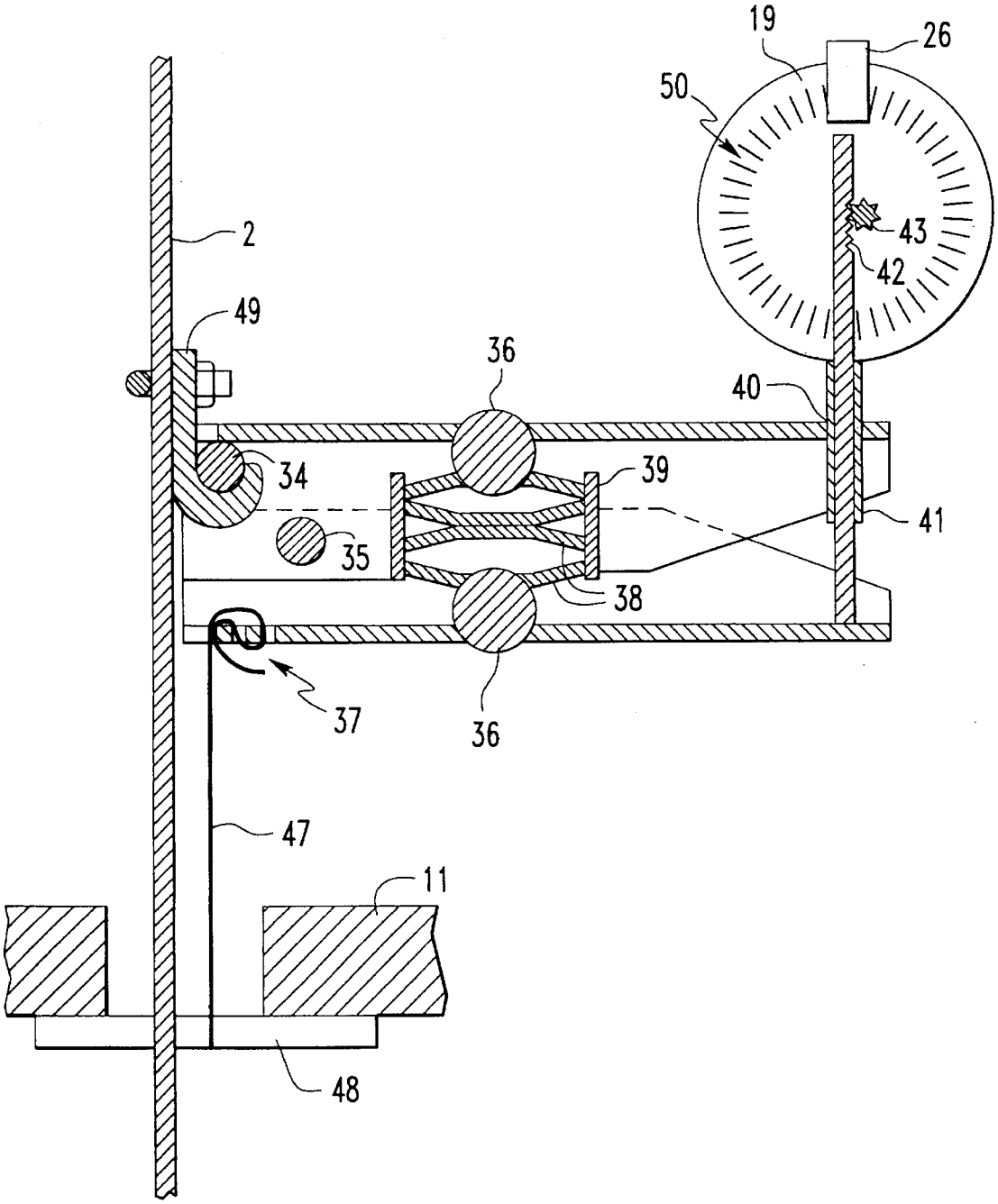

FIG. 9 illustrates another embodiment of a force sensing element 8 which differs from the embodiment shown in FIG. 7 by the provision of a position pick-up for sensing the displacement of pull rod 29' relative to guide sleeve 27'. This position pick-up comprises a perforated strip 35 which is connected to pull rod 29' and displaceable relative to the guide sleeve and which includes light passage holes 20' arranged equidistantly along a line. A first light barrier means 25" and a second light barrier means 26" are provided for scanning passage holes 20'. The connection of force sensing element 8 to cable 2 and its support on ceiling 11 are analogous to FIG. 7.

The motional direction of the pull rod can be determined by using two respective light barriers in the position pick-ups for the force sensing elements.

Figure 11:
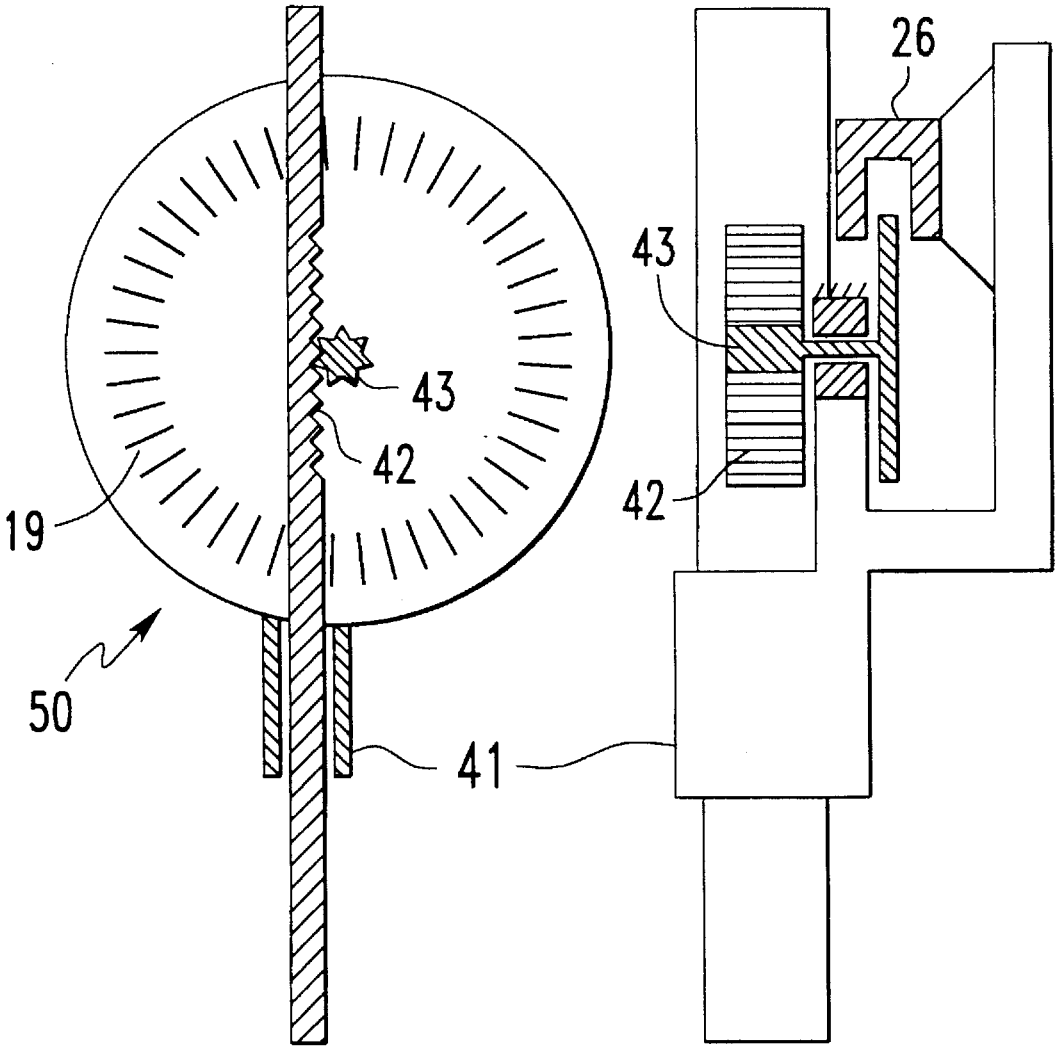
FIG. 11 shows a position pick-up (dial gauge) which can be used in the force sensor of FIG. 10 as a transducer.

FIG. 10 illustrates another embodiment of a force sensor 8. As far as its arrangement is concerned, this sensor generally corresponds to the embodiment illustrated in FIG. 7, but differs therefrom in that the force existing between the point of impact 34 and the elongated holes of the belt fastening 37 does not directly act on the spring, but is diverted via joint 35 and presses via support balls 36 against disk springs 38. Disk springs 38 are externally guided by a sleeve 39. The pick-up accommodating means 40 serves to accommodate the position pick-up (dial gauge) 50 according to FIG. 11. Like the position pick-up illustrated in FIGS. 3 and 4, it comprises a perforated disk 19 and two light-barrier measuring means 26. The perforated disk 19 is driven via the toothed wheel 43 by the toothed rack 42. A readjusting spring serves to eliminate the play between toothed wheel 43 and toothed rack 42. This position pick-up can be fixed on the clamping shaft 41 to the pick-up accommodating means 40 of the force sensor (FIG. 10) so as to scan the spring path given by the lever ratio joint 35—support ball 36 and pick-up accommodating means 40.

Measurements regarding travel distances, speeds and accelerations of the elevator car as a function of time and of the path, respectively, in dependence upon the signals which control the movement of the elevator car and are supplied by the control circuit of the elevator system can be carried out and recorded with the apparatus illustrated in FIG. 2 and in FIGS. 3–6 and 12. The resultant curves can be displayed on the screen of a computer or may be printed out by a printer. Statements can be made about the effectiveness of brake and catch device by comparison with the desired curves.

Figure 13:
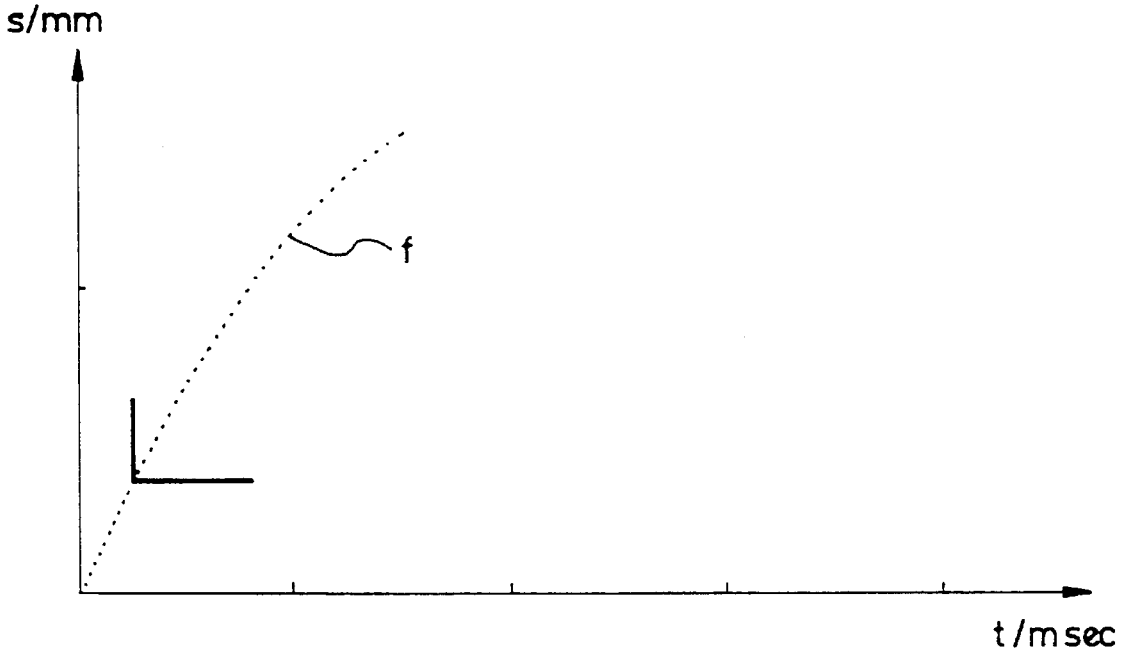
FIG. 13 is a catch diagram with the actually recorded function f in dependence upon path (s) over time (t)

FIG. 13 illustrates a typical course of a curve (f) with a path (s) over time (t), as is recorded during a catch operation. This curve (f) in FIG. 13 may be shown on a screen or printed out by a printer.

Figure 14:
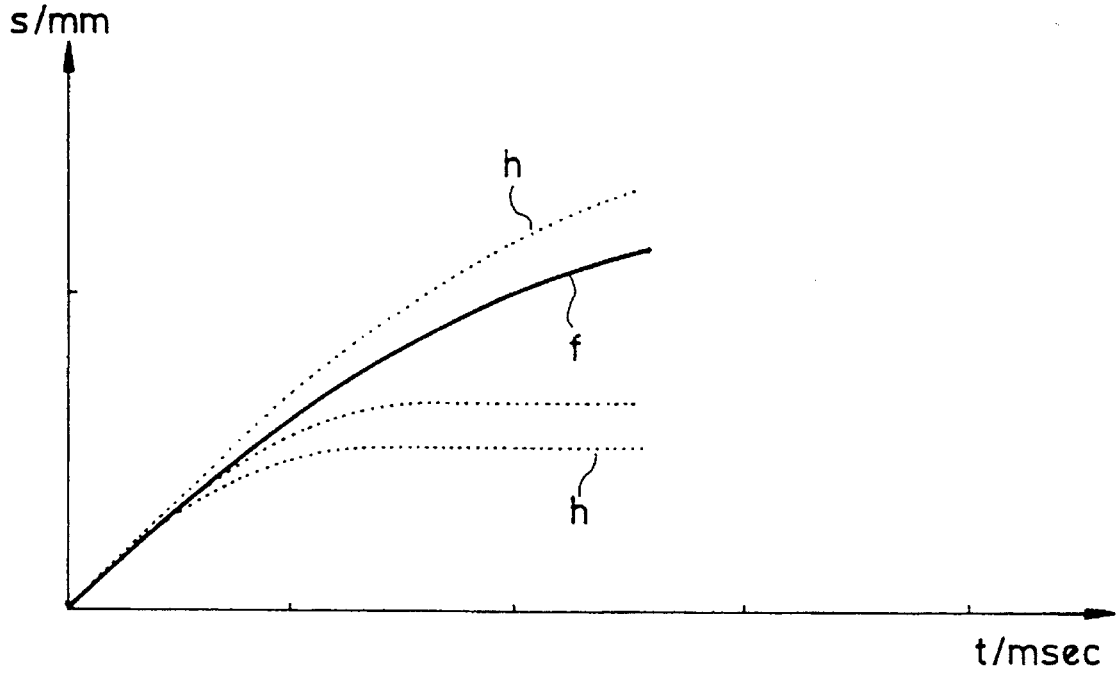
FIG. 14 is a catch diagram with catch curve f of FIG. 13 and with envelopes h serving as limit values for the catch curve.

FIG. 14 also shows a catch diagram with curve (f). This diagram, however, is additionally superimposed with the calculated limit curves h, so that a statement can be made about the operativeness of the catch device. This diagram, too, is an original diagram as is shown on a screen.

The braking path of the elevator car as loaded with the rated load in the downward direction can be extrapolated from two braking path measurements that are carried out one after the other (once in the empty state upwards and once in the empty state downwards). Furthermore, the brake deceleration in an elevator car loaded with 1.5 times the rated load can be calculated. This is possible because these different braking paths ($s_{empty}$ downwards in relation to $s_{empty}$ upwards) are due to known mass differences. All other masses involved (including rotary ones) take equally part in both tests and can consequently be eliminated. Speeds can also be determined because in this case, too, the respective times for the paths are stored in a table in the computer. Hence, the braking path or the brake deceleration can be calculated at any load by means of two braking tests with an empty elevator car. Hence, there is the possibility of inferring the brake characteristics under load from the empty elevator car. As has been described, the deceleration under load can also be calculated. This deceleration, in turn, determines the dynamic proportion in the drive capability test with load. Since, this deceleration can be calculated and the decelerated masses (elevator car, counterweight) are known, the dynamic amount can also be calculated and replaced by an additionally applied force during testing of the drive capability without load.

The non-slippage property (drive capability) of the cable assembly can also be determined with the aid of the above-described apparatus illustrated in FIGS. 7–11. To this end, the pull rod of the force sensing element according to FIG. 7 or 9 or 10 must be connected to one or several cables 2 of the cable assembly with the aid of a suitable cable clamp 49. The guide sleeve of the force sensing element is fastened via a belt band 47 and a crossbar 48 to a fixed point, expediently to ceiling 11 which closes the elevator shaft. During the slippage test the tensile force must be increased by rotating the hand wheel or moving the drive until a determined limit value is reached and the transducer produces a warning signal, or the cable or the cables start to slip on the driving pulley. The beginning slipping action can be visually determined, e.g. by displacing markings made or by evaluating the signals from the first position pick-up which is connectable to the cable assembly and from the second position pick-up which is connectable to the driving pulley.

The drive capability can also be determined with the above-described apparatus in the following way:

The two position pick-ups are each in motional communication with the driving pulley and a carrying cable. Furthermore, control line 9 is connected to the elevator control. The movement of the elevator is now decelerated from full speed with a maximum braking force. From the time of the beginning of the deceleration the position pick-ups sense the distances covered. The latter are stored in the computer in a table with the associated times. It can then be determined by evaluating this table whether and to which extent the carrying cable has slipped relative to the driving pulley. Furthermore, it can be found out at which deceleration the adhesive friction has been overcome and the slipping action has started and at which deceleration the cables have come to a halt again relative to the driving pulley (transition from sliding friction to adhesive friction). Since the decelerated masses (cables, elevator car and counterweight) are known or can be determined, the corresponding forces can thus be directly extrapolated from the decelerations. Hence, it is also possible to indicate the load which must at least exist so that the elevator will slip, and to indicate at which load an adhesive friction will again be present.

To be able to detect path differences, the two position pick-ups must either output identical pulses for identical distances or must be synchronized with a correction factor. In each measuring operation the two position sensors are automatically calibrated again. This is accomplished in the following way: At the beginning of the braking operation, i.e. before the brake has been applied, the elevator moves at an almost constant speed. There are no additional forces between the carrying cable and the driving pulley. Both position sensors cover the same distance. If the number of the pulses of both position sensors are now related to one another, the quotient thereof is the synchronization factor of the two position sensors. This synchronization is e.g. accomplished through the software.

Furthermore, the above-described apparatus is capable of checking the control circuit of the elevator by controlling the time sequence of the control signals. It is e.g. possible to determine the time required by the control system for disabling the drive or for applying a brake after a safety switch has been opened.

The evaluation unit comprises a number of functional means which are partly implemented as software. One functional means is designed to determine the speed and/or acceleration values. The measurement of the speed can be triggered by striking keys of the keyboard, or triggering is effected through signals of the control circuit of the elevator. Measurement results can be displayed on the screen of a personal computer or may be printed out by a printer as a complete test report if necessary. The acoustic transducer comprised by interface module 14 may be activated so as to draw the attention above all to inadmissible test values. The screen may also be used for displaying instructions for the operation of the apparatus.

In the above-described embodiment the sensor interface causes the computer to interrupt its work and to update the corresponding internal memories for path and possibly time when an external event takes place, e.g. when the perforated disk advances.

However, it is also possible to supply these pulses to a forward/rearwards counter and to display the result with the aid of a conventional display module. The corresponding forces or distances can then be assigned to the displayed values. In the above-described embodiment the values to be measured have been directly converted into digital signals. Alternatively, the measurement values may also be acquired in analog form, and e.g. speeds and thus distances and accelerations may be measured with the aid of a tachogenerator, or forces may be determined by means of strain gauges or piezoelectric pressure transducers. These analog signals can be converted by an A/D converter into digital signals and then further processed by an evaluation unit.

In the above-described embodiment timer and acoustic transducer have been accommodated with the necessary control in the sensor interface. Alternatively, it is possible to dispense with these units and to employ corresponding members in the computer where they are controlled by the software. In addition, is is possible to exchange data between computer and interface module not via an input/output module of the input/output interface, but to resort to standard interfaces (serial or parallel) in the computer.

The apparatus and method of the invention offer the possibility of sensing the movement of travel of an elevator with respect to the distance covered and the associated time in a very precise way. Accelerations and decelerations can be recorded in a very fine time raster. When the test method is performed, it is possible to decelerate or accelerate the empty elevator car and the counterweight and to make statements about the active forces on the basis of the motion parameters measured. When the forces are related with the loaded elevator, the loading condition can be inferred from the empty elevator car.

When the method is performed in practice, the empty elevator car can be braked during the upwardly directed travel, with an operator holding a position pick-up 7 relative to the running carrying cable prior to and during the deceleration. The question whether or not the carrying cable slips on the driving pulley can here be answered visually by marking the position of the carrying cable on the driving pulley with a stroke prior to deceleration.

There are now the following possibilities:

1. The deceleration measured during the braking of the elevator is greater than or equal to a calculated limit value; the carrying cable has here not slipped relative to the driving pulley. The adhesive friction between the driving pulley and the carrying cable is sufficient in this case; the drive capability is ensured.
2. The deceleration measured during the braking of the elevator is below a calculated limit value, and the carrying cable has slipped relative to the driving pulley. The adhesive friction as well as the drive capability are insufficient in this case.
3. The deceleration measured during the braking of the elevator is above a calculated limit value, and the carrying cable has slipped relative to the driving pulley. In this case the brake must be adjusted such that there is a softer braking action, and the test must be repeated.
4. The deceleration measured during the braking of the elevator car is below a calculated limit value; the carrying cable has not slipped relative to the driving pulley. In this case the brake must be adjusted such that there is a harder braking action, and the test must also be repeated.

The drive capability of the driving pulley under load can thus be determined by varying the braking action although the test is performed with an unloaded, moved elevator car.

In another embodiment of this method a position pick-up 7 is secured to the carrying cable and a position pick-up of the same type is additionally provided on the driving pulley. Hence, the movements of the driving pulley and the cable are sensed and recorded separately in dependence upon time.

The empty car of the elevator is either accelerated or decelerated for checking the drive capability. A comparison of the movements, in particular a comparison of the two movement curves, reveals not only whether, but also by how much the carrying cable has slipped relative to the driving pulley. Hence, the dynamic characteristics regarding the drive capability under load can thus be determined by evaluating the slippage path in response to deceleration or acceleration.

This is accomplished in that e.g. the double-type position pick-up according to FIG. 12 is simultaneously secured to the driving pulley and a cable during the braking operation.

The elevator brake is held in the stand-by position by a braking magnet which is constantly connected to an electric power. When the power supply to the braking magnet is interrupted to perform the test method, the brake becomes active. The intended interruption of the power supply to the magnet can be used as a trigger for starting the measuring operation.

The short period between the interruption of the power supply and the subsequent action of the brake can be used for synchronizing the position pick-ups for the driving pulley and the cable. A constant speed exists at both members during this short interval. The two position sensors which are assigned to the carrying cable and the driving pulley, respectively, are synchronized during this period by comparing the number of counting pulses of the one position sensor with that of the second sensor. The resultant factor serves to convert counting pulses of both pick-ups into distances. Possibly existing manufacturing tolerances between the two position sensors, as well as different degrees of wear are automatically eliminated.

The curves recorded by the two position sensors during the checking of the elevator can be compared with each other. They are congruent in the first portion because prior to the application of the brake the carrying cable rests on the driving pulley due to the adhesive friction. The force in the carrying cable increases on account of the beginning deceleration until the point is reached at which this force overcomes the adhesive friction and the carrying cable slips on the driving pulley.

From this moment onwards the two recorded curves of the carrying cable and the driving pulley diverge. Moreover, the elevator car is not so much decelerated at this moment because the threshold value of the adhesive friction has been exceeded and this energy is transformed into sliding friction. At the same time, the driving pulley is braked more strongly because the driving force of the carrying cable which acts on the driving pulley is reduced by the difference between adhesive friction and sliding friction.

The test method is virtually carried out as follows:

1. The braking force of the brake is so adjusted that it is as great as possible; it acts on the driving pulley via the gearing.
2. The empty elevator car is made to move, whereupon the brake starts to operate after interruption of the braking magnet, and the motion parameters of driving pulley and carrying cable are recorded separately.
3. If the carrying cable has slipped relative to the driving pulley, the drive capability is calculated and displayed by comparing the motion parameters recorded.
4. If the carrying cable has not slipped on the driving pulley, but if the deceleration has been above a predetermined limit value, the minimum drive capability is calculated and displayed.
5. If the carrying cable has not slipped relative to the driving pulley, but if the deceleration has been below a predetermined limit value, the test must be repeated with a brake having a stronger effect.

I claim:

1. An apparatus for sensing motion parameters of an elevator that has at least one cable assembly which is guided over a driving pulley and has one elevator car suspended therefrom at one end and a counterweight at an opposite end, wherein the elevator car is driven by a drive motor, which acts on the driving pulley, and a braking device connected to the driving pulley, the drive motor and braking device being controlled by a control circuit, the apparatus comprising;

an evaluation unit having a timer and a plurality of in-puts connected to the control circuit, at which control signals are present to selectively accelerate and decelerate the elevator car and the counterweight, a first position pick-up, connected to one of the in-puts of the evaluation unit in communication with the cable assembly; and a second position pick-up, connected to another of the plurality of in-puts of the evaluation unit, communicating with the driving pulley;

the evaluation unit further including means for determining at least acceleration values according to distances sensed by the first and second position pick-up for checking non-slippage of the at least one cable assembly relative to the driving pulley, the evaluation unit further including in-put switches for triggering evaluation processes, including the determination of distances, speeds and accelerations by signals from the control circuit.

2. An apparatus as defined in claim 1, wherein said evaluation unit comprises a display device for displaying evaluation results.

3. An apparatus as defined in claim 2, wherein said display device is a screen display device.

4. An apparatus as defined in claim 2 wherein said evaluation unit comprises a display device for giving operating instructions to a user of said apparatus.

5. An apparatus for sensing parameters of an elevator that has at least one cable assembly which is guided over a driving pulley and bas one elevator car suspended therefrom at one end and a counterweight at an opposite end, wherein the elevator car is driven by a drive motor, which acts on the driving pulley, add a braking device connected to the driving pulley, the drive motor and braking device being controlled by a control circuit, the apparatus comprising;

an evaluation unit having a timer and in-puts connected to the control circuit, at which control signals are present to selectively accelerate or decelerate said elevator car and counterweight;

a first position pick-up, connected to one of the in-puts of the evaluation unit in communication with the cable assembly; and a second position pick-up, connected to another of the plurality of in-puts of the evaluation unit in communication with the driving pulley;

said evaluation unit further including means for determining at least one of speed and acceleration values according to distances sensed by the first and second position pick-up means for checking non-slippage of the at least one cable assembly relative to said driving pulley; said evaluation unit further including a warning signal activated in response to predetermined evaluation results.

6. An apparatus as defined in claim 5 wherein each said first and second position pick-up comprises a perforated disk rotatable in accordance with the distance to be measured, and at least one light barrier for scanning said perforated disk.

7. An apparatus as defined in claim 6, wherein said light barrier is a double-type light barrier for determining the direction of rotation.

8. An apparatus as defined in claim 6, wherein said perforated disk of each first and second pick-up is driven by at least one of a driving roller pressed against said lifting cable and said driving pulley.

9. An apparatus as defined in claim 8, wherein said driving roller comprises a guide groove for a carrying cable of said lifting cable assembly.

10. An apparatus as defined in claim 8, wherein said driving roller is plastic.

11. An apparatus as defined in claim 1, comprising a force sensing element removably arranged between a fixed point and at least one cable of the cable assembly, said force sensing element being connected to an in-put of said evaluation unit.

12. An apparatus for sensing motion parameters of an elevator that has at least one cable assembly which is guided over a driving pulley and has one elevator car suspended therefrom at one end and a counterweight at an opposite end, wherein the elevator car is driven by a drive motor, which acts on the driving pulley, and a braking device connected to the driving pulley, the drive motor and braking device being controlled by a control circuit, the apparatus comprising;

an evaluation unit having a timer and in-puts connected to the control circuit, at which control signals are present to selectively accelerate or decelerate said elevator car and counterweight;

a first position pick-up connected to one of the in-puts of the evaluation unit in communication with the cable assembly;

a second position pick-up connected to one of the in-puts of the evaluation unit communicating with the driving pulley;

said evaluation unit further including means for determining at least acceleration values according to distances sensed by the first and second position pick-up for checking non-slippage of said at least one cable assembly relative to the driving pulley, and a force sensing element removably arranged between a fixed point and at least one cable of the cable assembly, said force sensing element being a spring-type sensing element connected to one of the in-puts of said evaluation unit.

13. An apparatus as defined in claim 12, wherein said spring-type sensing element comprises at least one of a guided spiral spring and a disk spring.

14. An apparatus as defined in claim 12, wherein the spring-type sensing element has a spring excursion and a change in spring excursion can be sensed by a corresponding one of the first and second position pick-ups.

15. An apparatus as defined in claim 14, wherein each said first and second position pick-up comprises a coding strip provided with regularly arranged light transmission windows for scanning by at least one light barrier.

16. An apparatus as defined in claim 15, wherein said coding strip is a sheet metal strip with regularly spaced holes.

17. An apparatus as defined in claim 15, further comprising a double-type light barrier, and wherein said coding strip is scanned by said double-type light barrier.

18. An apparatus as defined in claim 14, wherein each said first and second position pick-up comprises in the alternative a perforated disk or dial gauge rotatable in accordance with a change in spring excursion and a double-type light barrier for scanning said disk or dial gauge.

19. An apparatus as defined in claim 1, wherein said evaluation unit includes a personal computer.

20. An apparatus as defined in claim 19, wherein said evaluation unit comprises an interface module arranged upstream in the direction of signal flow of an input/output interface of said personal computer and used for preprocessing the signals of the control means and the measuring signals of each said first and second position pick-up and of said force sensing element, respectively.

21. An apparatus as defined in claim 20 wherein said interface module comprises a logic circuit for determining at least one of the direction of movement of said elevator and the direction of spring excursion.

22. An apparatus as defined in claim 20, wherein said interface module contains an acoustic transducer.

23. A method of sensing motion parameters of an elevator having at least one cable assembly passed over a driving pulley, the at least one cable assembly having at one end a suspended elevator car and at another end a counterweight, said driving pulley being driven by a drive motor controlled by an electric control circuit, and connected to a braking device controlled by the control circuit, wherein said at least one cable assembly, said elevator car and said counterweight are selectively accelerated or decelerated for checking the non-slippage of at least one of the cable assembly relative to said driving pulley during normal travel of said elevator, with the motion parameters of said at least one cable assembly and said driving pulley being separately sensed depending upon time and compared with a given motion limit parameter, sufficient non-slippage of the at least one cable assembly relative to said driving pulley, for operating said elevator, being attained when the limit parameter is exceeded.

24. A method as defined in claim 23, wherein the non-slippage of the at least one cable assembly relative to said driving pulley is determined on the basis of the measured difference between motion parameters of said at least one cable assembly and said driving pulley.

25. An apparatus for sensing motion parameters of an elevator that has at least one cable assembly which is guided over a driving pulley and has one elevator car suspended therefrom at one end and a counterweight at an opposite end, wherein the elevator car is driven by a drive motor, which acts on the driving pulley, and a braking device connected to the driving pulley, the drive motor and braking device being controlled by a control circuit, the apparatus comprising;

an evaluation unit having a timer and in-puts connected to the control circuit, at which control signals are present to selectively accelerate or decelerate said elevator car and counterweight, a first position pick-up, connected to one of the in-puts of the evaluation unit, in communication with the cable assembly;

a second position pick-up connected to another of the inputs of the evaluation unit in communication with the driving pulley;

said evaluation unit further including means for determining at least acceleration values according to distances sensed by the first and second position pick-ups for checking non-slippage of the at least one cable assembly relative to the driving pulley; and a force sensing element removably arranged between a fixed point and at least one cable of the cable assembly, to check non-slippage of the cable assembly relative to said driving pulley, displacement of said cable assembly relative to said driving pulley being detected by said first and second position pick-ups, said force sensing element being connected to one of the plurality of in-puts of said evaluation unit.

* * * * *

UNITED STATES PATENT AND TRADEMARK OFFICE

CERTIFICATE OF CORRECTION

PATENT NO. : 5,578,801

DATED : November 26, 1996

INVENTOR(S) : Hanspeter Hofmann

It is certified that error appears in the above-indentified patent and that said Letters Patent is hereby corrected as shown below:

Claim 4, column 9, line 59, change "claim 2" to --claim 1--.

Claim 5, column 9, line 64, change "bas" to --has--.

Signed and Sealed this

Twenty-ninth Day of April, 1997

Bruce Lehman

*Attest:*

BRUCE LEHMAN

*Attesting Officer*

*Commissioner of Patents and Trademarks*